United States Patent [19]

Nakajima et al.

[11] Patent Number: 4,546,739

[45] Date of Patent: Oct. 15, 1985

[54] FUEL INJECTION VALVE WITH VARIABLE DISCHARGE AREA OF NOZZLE HOLES

[75] Inventors: Nobuyuki Nakajima; Keiichi Yamada, both of Higashimatsuyama, Japan

[73] Assignee: Diesel Kiki Co., Ltd., Tokyo, Japan

[21] Appl. No.: 636,828

[22] Filed: Aug. 1, 1984

[30] Foreign Application Priority Data

Aug. 10, 1983 [JP] Japan ..... 58-146135

[51] Int. Cl.[4] ..... F02M 61/20

[52] U.S. Cl. ..... 123/299; 123/472; 239/533.4; 239/585

[58] Field of Search ..... 123/299, 300, 446, 472, 123/478; 239/533.2–533.12, 585

[56] References Cited

U.S. PATENT DOCUMENTS

| | | | |
|---|---|---|---|
| 2,398,834 | 4/1946 | Kammer | 123/299 |
| 2,898,051 | 8/1959 | Teichert | 239/533.5 |
| 3,095,153 | 6/1963 | Soth | 239/533.2 X |
| 3,339,848 | 9/1967 | Geiger | 239/533.4 X |

FOREIGN PATENT DOCUMENTS

| | | | |
|---|---|---|---|
| 2084248 | 4/1982 | United Kingdom | 239/533.9 |

*Primary Examiner*—Tony M. Argenbright

*Attorney, Agent, or Firm*—Frishauf, Holtz, Goodman & Woodward

[57] ABSTRACT

A fuel injection valve for internal combustion engines wherein a nozzle needle is slidably fitted in a nozzle body so as to alternately close and open nozzle holes formed therein. A selector valve is axially slidably fitted through the nozzle needle to selectively close or open second nozzle holes formed in the nozzle body. While the nozzle needle has a predetermined valve opening pressure set by a nozzle spring, the selector valve is controlled to operate in response to operating conditions of the engine by control means such that the second nozzle holes are opened in predetermined operating regions of the engine. Thus, the overall discharge area of the nozzle holes can be controlled to values appropriate to operating conditions of the engine. Preferably, the selector valve comprises a spool valve which can assume a seated position wherein its spool is fitted in an axial through hole formed in the tip of the nozzle body to close the second nozzle holes opening in the peripheral wall of the axial through hole, and a lifted position wherein the spool is disengaged from the axial through hole to open the second nozzle holes.

5 Claims, 5 Drawing Figures

FUEL INJECTION VALVE WITH VARIABLE DISCHARGE AREA OF NOZZLE HOLES

BACKGROUND OF THE INVENTION

This invention relates to a fuel injection valve for internal combustion engines, in which the nozzle holes have its total discharge area variable in response to operating conditions of the engine.

In a conventional fuel injection valve employed in Diesel engines, a nozzle needle, which alternately closes and opens nozzle holes formed in a nozzle body, is urged in the valve closing direction by a nozzle spring. The nozzle needle has a tapered seating surface disposed in a pressure chamber formed within the nozzle body, whereby during the injection stroke pressurized fuel from an associated fuel injection pump, introduced into the pressure chamber urgingly acts upon the tapered seating surface of the nozzle needle to lift the nozzle needle against the force of the nozzle spring to effect injection of fuel through the resultantly open nozzle holes.

According to this type fuel injection valve, in a low speed and low load region of the engine the speed of fuel delivered from the fuel injection pump is so low that the injection pressure often cannot be elevated to a required level sufficient to obtain good atomization of the injected fuel. Therefore, in such low speed and low load region of the engine, the discharge area of the nozzle holes should desirably be reduced so as to achieve satisfactory atomization of the injected fuel. On the other hand, however, in a high speed and high load region of the engine, the injection quantity per unit time should be large enough to assure required high engine output, and to this end the discharge area of the nozzle holes should desirably be increased in such high speed and high load region of the engine. However, the above conventional fuel injection valve is not adapted to vary the discharge area of the nozzle holes. Therefore, if a fuel injection valve of this type is designed to have a nozzle hole discharge area appropriate to a high speed and low load region of the engine, the injection pressure can be too low to obtain satisfactory fuel atomization in a low speed and low load region of the engine.

To overcome this disadvantage, fuel injection valves employing two coaxially disposed nozzle needles have been proposed by Japanese Provisional Patent Publication (Kokai) No. 53-110722, in which a first nozzle needle is formed therein with an axial hole through which a second nozzle needle is slidably fitted. The first and second nozzle needle are urged by respective nozzle springs whose valve opening pressure is set at different values, in directions closing respective groups of nozzle holes. When the engine is operating in a low speed and low load region including the idling region, the first nozzle needle alone is lifted, whereas when the engine is operating in a high speed and high load region, also the second nozzle spring is lifted together with the first nozzle spring at the same time, to effect fuel injection through all the nozzle holes, thereby increasing the effective overall nozzle hole discharge area.

According to the proposed nozzle needle arrangement, however, it is difficult to set the urging force of the nozzle spring urging the second nozzle to a proper value with accuracy. As a result, it cannot be assured that the second nozzle needle is lifted in operating regions of the engine where the fuel injection quantity should be increased, and is kept in a seated position to close its nozzle holes in other operating regions of the engine.

SUMMARY OF THE INVENTION

It is an object of the invention to provide a fuel injection valve for internal combustion engines, in which the overall discharge area of the nozzle holes can be set to values appropriate to operating conditions of the engine, with certainty.

It is a further object of the invention to provide a fuel injection valve for internal combustion engines, which employs a selector valve constructed so as to effect selective closing and opening of nozzle holes in a smooth and stable manner, thereby further enhancing the accuracy of control of the fuel injection quantity.

According to the present invention, a fuel injection valve for use in an internal combustion engine is provided, wherein a nozzle body is formed with at least one first nozzle hole and at least one second nozzle hole, the second nozzle hole being located closer to the tip of the nozzle body than the first nozzle hole. A first valve as the nozzle needle is fitted in an axial hole formed in the nozzle body for axial movement therealong to alternately close and open the first nozzle hole. A second valve is fitted in an axial hole formed in the first valve for axial movement therealong to selectively close or open the second nozzle hole. A nozzle spring urges the first valve against the first nozzle hole to set the valve opening pressure thereof at a predetermined value. Control means controls the operation of the second valve in response to operating conditions of the engine such that the second nozzle hole is opened by the second valve when the engine is operating in at least one predetermined operating region.

The nozzle body has an axial through bore formed in the tip thereof, and second nozzle hole has an inner end thereof terminating in the peripheral wall of the axial through hole. The second valve comprises a spool valve having a first land axially extending from the first valve toward the tip of the nozzle body and disposed to selectively assume a seated position wherein the first land is fitted in an end of the axial through hole remote from the first body to close the second nozzle hole, and a lifted position wherein the first land is disengaged from the axial through hole to open the second nozzle hole, an annular groove adjacent the first land and disposed in the axial through hole at a location such that it permanently faces the inner end of the second nozzle hole, and a second land adjacent the annular groove and opposed to the first land with respect to the annular groove. The second land is permanently positioned within the axial through hole.

The above at least one predetermined operating region may include a high speed and high load region of the engine and a starting region of the engine.

Preferably, the second valve may be formed by a spool valve, whereby the second valve is axially acted upon by the injection pressure of fuel to a reduced extent, to allow the second valve to make a smooth lifting motion and stably assume a seated position and a lifted position.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
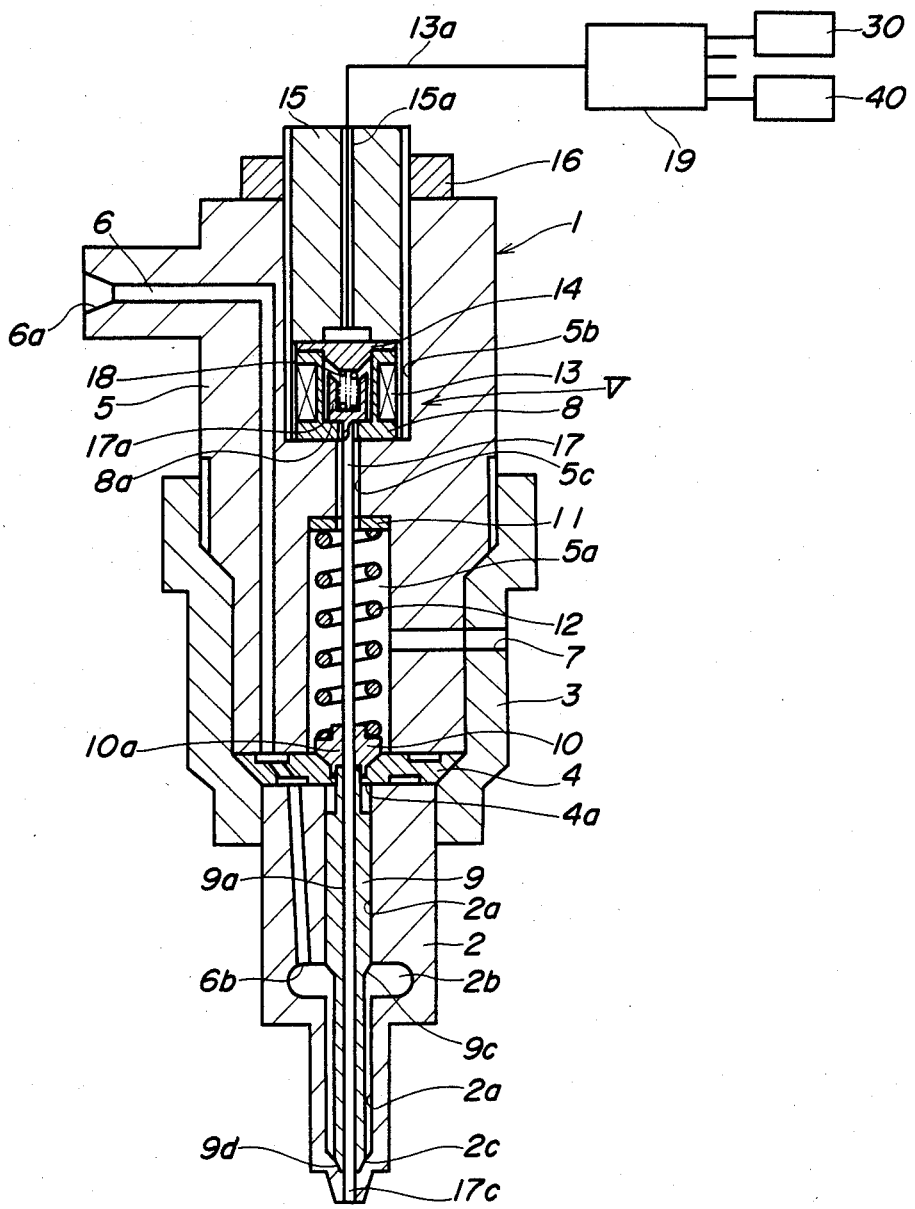
FIG. 1 is a longitudinal sectional view of a fuel injection valve according to an embodiment of the invention.
Figure 2:
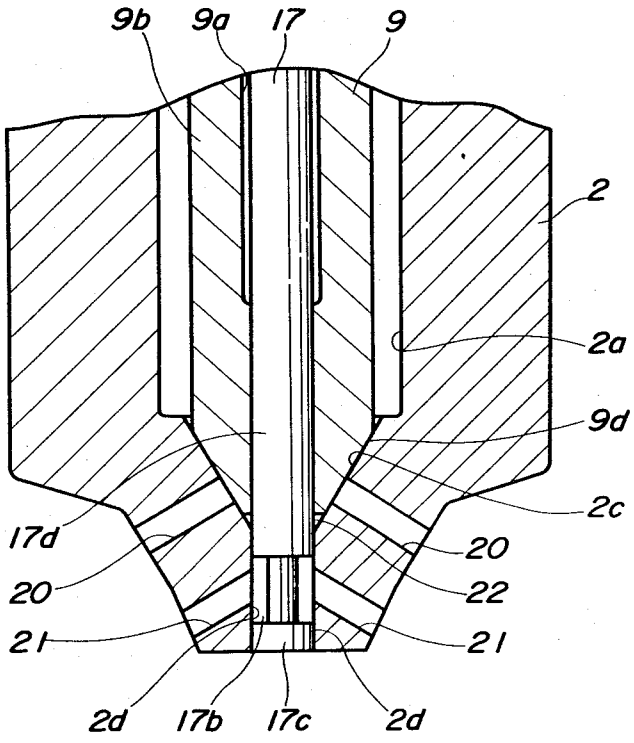
FIG. 2 is a longitudinal sectional view, on an enlarged scale, of essential part of the fuel injection valve of FIG. 1.

Referring first to FIGS. 1 and 2, there is illustrated a fuel injection valve according to the invention. In the fuel injection valve 1, a nozzle body 2, which is projected into a cylinder of an internal combustion engine, not shown, is fastened to an end face of a generally cylindrical nozzle holder 5 via a distance piece 4 by means of a retaining nut 3 in a liquidtight manner.

A fuel passage 6, which is to be connected to a fuel injection pump, not shown, axially extends through the nozzle holder 5, the distance piece 4 and the nozzle body 2, terminating at an end 6*a* in an upper lateral side wall of the nozzle holder 5 and opening at the other end 6*b* in a pressure chamber 2*b* formed within the nozzle holder 2. A spring chamber 5*a* is defined by a cavity formed in the nozzle holder 5 along its axis and an opposed end face of the distance piece 4. A nozzle needle 9 extends through an axial hole 4*a* formed through the distance piece 4 and is slightly projected at one end into the spring chamber 5*a*. The nozzle needle 9 is slidably fitted through an axial bore 2*a* formed through the nozzle body 2 and has a tapered pressure-applying portion 9*c* formed at an axially intermediate location and disposed within the pressure chamber 2*b*. A spring seat 10 is arranged within the spring chamber 5*a* and has a lower recessed end face thereof urgedly receiving the one end of the nozzle needle 9. A nozzle spring 12 is tautly interposed between the spring seat 10 and an upper end face of the spring chamber 5*a*, with a spring force-setting shim 11 interposed between the spring 12 and the upper end face of the spring chamber. The nozzle needle 9 has a lower end face thereof shaped as a seating surface 9*d* and urged against an opposed valve seat 2*c* formed within a lower end portion of the nozzle body 2, by the force of the nozzle spring 12. A drain passage 7 is formed through lateral side walls of the spring chamber 5*a* and the retaining nut 3 and leads to a fuel tank, not shown.

A recess 5*b* is formed in an upper end face of the nozzle holder 5 along its axis at a location above the spring chamber 5*a*, in which is arranged a solenoid 13 forming part of an electromagnetic selector valve V, together with a casing 8 supporting the solenoid 13. A yoke 14 is mounted within the recess 5*b* and supported on the casing 8. The recess 5*b* has its wall threaded and receives a cap 15 threadedly fitted therein. The cap 15 is rigidly fastened to the nozzle holder 5 by means of a nut 16 threadedly fitted on the cap.

A spool 17 of the selector valve V, in the form of a long and slender rod, axially movably extends through an axial hole 5*c* formed in the nozzle holder 5 along its axis and extending between the recess 5*b* with the spring chamber 5*a*, as well as through an axial hole 10*a* formed through the spring seat 10 and an axial bore 9*a* formed through the nozzle needle 9, with its tip 17*c* permanently projected from the lower end face of the nozzle needle 9. The spool 17 has its upper end formed integrally with an enlarged stopper 17*a* axialy movably fitted within the solenoid 13 and downwardly urged by a return spring 18 tautly interposed between a recessed bottom face in the stopper 17*a* and an opposed end face of the yoke 14. Thus, when the solenoid 13 is energized, the stopper 17*a* is magnetically drawn toward the yoke 14 to cause the spool 17 to be lifted against the force of the spring 18 until the stopper 17*a* is brought into pressure contact with the yoke 14. When the solenoid 13 is deenergized, the stopper 17*a* or the spool 17 is returned downward by the force of the spring 18 into the position illustrated in FIG. 1 wherein the lower end face of the stopper 17*a* is in pressure contact with an end wall 8*a* of the casing 8.

A lead wire 13*a* extends from the solenoid 13 to the outside through a passage 15*a* formed in the cap 15 along its axis and is connected to an electronic control unit 19. The control unit 19 is operable in response to input signals indicative of operating parameters of the engine, including at least output signals from an engine rotational speed sensor 30 and a throttle valve opening sensor 40, etc. to determine whether the engine is operating in an idling region or another low speed and low load region, or in a high speed and high load region. If the engine is determined to be in the former region, the control unit 19 deenergizes the solenoid 13, while if the engine is determined to be in the latter region, the solenoid 13 is energized.

As clearly shown in FIG. 2, the valve seat 2*c* formed within the lower end portion of the nozzle body 2 is in the form of an annular tapered surface, continuous from the axial bore 2*a*, and a cylindrical axial bore 2*d* is formed in the tip of the nozzle body 2 and axially extends from the valve seat 2*c* and along the axis of the nozzle body 2, terminating in an lower end face of the nozzle body 2. The tip of the spool 17 is fitted in the axial bore 2*d* in a liquidtight manner. The nozzle body 2 has its lower end portion further formed with a first group of nozzle holes 20 and a second group of nozzle holes 21, the nozzle holes in each group being obliquely directed with respect to the axis of the nozzle body 2 and circumferentially arranged. The first group of nozzle holes 20 terminate at inner ends in the valve seating surface 2*c*, while the second group of nozzle holes 21 terminate at inner ends in the peripheral wall of the axial bore 2*d* at an axial location closer to the tip of the nozzle body 2 than the first group of nozzle holes 20.

The nozzle needle 9 comprises a stem 9*b* fitted in the axial bore 2*a* of the nozzle body 2, the aforementioned tapered pressure-applying portion 9*c* disposed in the pressure chamber 2*b*, and an annular tapered seating surface 9*d* disposed for seating contact with the valve seat 2*c* by the force of the nozzle spring 12. As shown in FIG. 2, the lower end of the spool 17 is formed with an annular groove 17*b* having a predetermined width and located at a predetermined axial location, and a first land 17*c* and a second land 17*d* defined at opposite ends of the annular groove 17*b*. In the position illustrated in FIG. 2, the first land 17*c* on the side of the tip of the spool 17 closes a lower end of the axial bore 2*d*, and the second land 17*d* an upper end of the same bore 2*d*, respectively. The spool 17 is so configurated that the lower end of the axial bore 2*d* is always closed by the land 17*c* while the spool 17 is lifted through its whole stroke. A valve chamber 22 is defined between the lower end face of the nozzle needle 9 and the valve seating surface 2*c*.

With the above described arrangement, pressurized fuel delivered from the fuel injection pump is fed through the fuel inlet 6*a*, the fuel passage 6 and into the pressure chamber 2*b*. When the fuel pressure within the pressure chamber 2*b* rises up to a predetermined value, the nozzle needle 9 is upwardly lifted against the force of the nozzle spring 12 by the pressure of fuel acting upon the tapered pressure-applying surface 9*c* of the nozzle needle, whereby a gap is formed between the seating surface 9*d* and the valve seating surface 2*c*. Pressurized fuel within the pressure chamber 2*b* flows through the above gap to be injected through the nozzle holes 20 into a combustion chamber of an engine cylinder, not shown. During such operation of the fuel injection valve 1, part of the fuel within the pressure chamber 2*b* leaks through small gaps between the axial bore 2*a* of the nozzle body 2 and the stem 9*b* of the nozzle needle 9 and between the axial bore 9*a* of the nozzle needle 9 and the spool 17 to lubricate the surfaces of these parts, and is fed to the spring chamber 5*a*. The fuel thus introduced into the spring chamebr 5*a* is guided through the drain passage 7 to be returned to the fuel tank.

Figure 3:
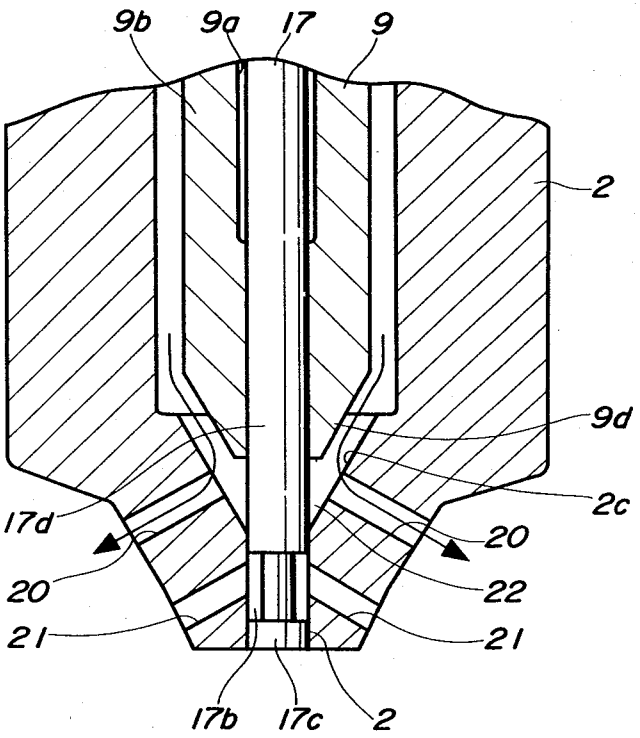
FIG. 3 is a view similar to FIG. 2, showing the fuel injection valve with a selector valve as the second valve in a seated position.

When the control unit 19 determines from the output signals from the parameter sensors 30, 40 that the engine is operating in a low speed and low load region including the idling region, it interrupts energization of the solenoid 13, whereby the spool 17 assumes a seated position with its tip closingly fitted in the through bore 2*d* and accordingly interrupting the communication between the valve chamber 22 and the second group of nozzle holes 21. In this position, as shown in FIG. 3, the nozzle needle 9 alone is lifted so that fuel is forced to pass the gap between the nozzle needle 9 and the axial bore 2*a* and valve seat 2*c* of the nozzle body 2 to be injected through the first group of nozzle holes 20 alone into the combustion chamber of the engine.

Figure 4:
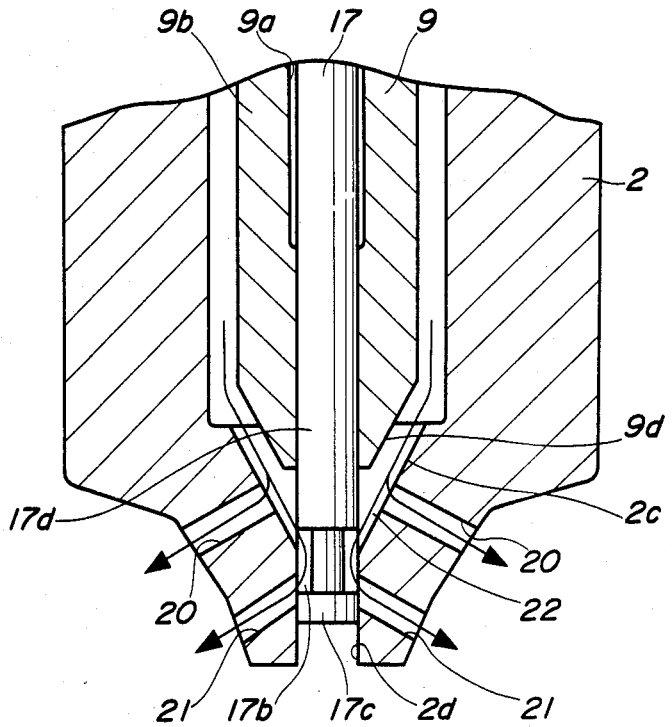
FIG. 4 is a view similar to FIG. 2, showing the fuel injection valve with the selector valve in a lifted position.

On the other hand, when the engine is determined to be in a high speed and high load region, the control unit 19 energizes the solenoid 13, whereby, as shown in FIG. 4, in addition to the lifting motion of the nozzle needle 9, also the spool 17 is lifted through a predetermined stroke and hence held in the lifted position so that the second group of nozzle holes 21 communicate with the valve chamber 22 via the annular groove 17*b* to allow injection of fuel through the second group of nozzle holes 21 as well as through the first group of nozzle holes 20. In this manner, as compared with injection in an idling or low speed and low load region of the engine, the total effective discharge area of nozzle holes increases to a larger value to assure injection of a proper amount of fuel into the engine in the high speed and low load region of the engine.

Figure 5:
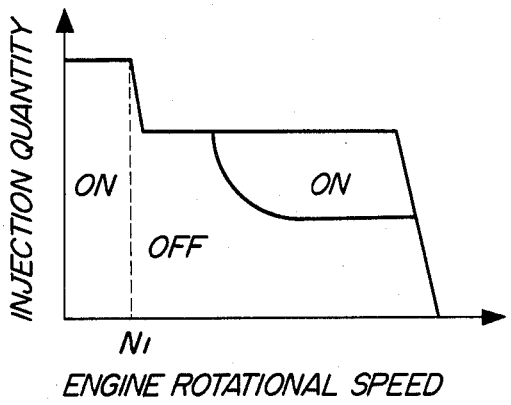
FIG. 5 is a graph showing operating regions of the engine defined by fuel injection quantity and engine rotational speed, in which the selector valve is to be opened.

Operating regions of the engine in which the solenoid 13 is to be energized (ON) and deenergized (OFF) may be set as shown in FIG. 5 for instance, in dependence on the engine rotational speed and the injection quantity as a function of the engine rotational speed and the throttle valve opening, sensed values of which are supplied from the engine rotational speed sensor 30 and the throttle valve opening sensor 40 to the control unit 19. Further, as shown in FIG. 5, also at the start of the engine when a large quantity of fuel is required, e.g. a starting region where the engine speed is lower than a predetermined speed N1 in FIG. 5, the solenoid 13 may be energized to supply an increased quantity of fuel to the engine to improve the startability of the engine.

As stated above, according to the fuel injection valve of the invention, while the nozzle needle operates with a predetermined valve opening pressure set by means of the nozzle spring, the selector valve V is driven in response to operating conditions of the engine. This enables to obtain an increased injection pressure by setting the nozzle hole discharge area to a relatively small value in an idling or low speed and low load region of the engine, and to obtain an increased fuel injection quantity through a relatively large value in a high speed and high load region of the engine. Thus, the nozzle hole discharge area values can be obtained throughout the whole operating regions of the engine, that are appropriate to operating conditions.

Moreover, according to the described and illustrated embodiment, the selector valve is formed by a spool valve having a cylindrical body. As a consequence, when the nozzle needle 19 is lifted as shown in FIG. 3, the spool 17 will not be acted upon to a substantial extent by the pressure force of fuel being injected, by virtue of the plain surface cylindrical body 17*d* of the spool 17 extending in the axial direction. Thus, the spool 17 is stably held in its closed position. Further, once the spool 17 has been lifted, the pressure force of fuel being injected equally acts upon the opposed end faces of the lands 17*c*, 17*d* while the fuel stays in the annular groove 17*b*, thereby allowing the spool 17 to be stably held in its lifted position. Assuming the shape of cylindrical through hole, the valve bore 2*d* facilitates its boring operation.

While a preferred embodiment of the invention has been described, variations thereto will occur to those skilled in the art within the scope of the presentive inventive concepts which are delineated by the appended claims.

What is claimed is:

1. A fuel injection valve for an internal combustion engine, comprising: a nozzle body having a tip, said nozzle body having at least one first nozzle hole and at least one second nozzle hole formed therein, said at least one second nozzle hole being located closer to the tip of said nozzle body than said at least one first nozzle hole; a first valve fitted in an axial hole formed in said nozzle body for axial movement therealong to alternately close and open said at least one first nozzle hole as a nozzle needle; a second valve fitted in an axial hole formed in said first valve for axial movement therealong to selectively close or open said at least one second nozzle hole; a nozzle spring urging said first valve against said at least one first nozzle hole to set the valve opening pressure thereof at a predetermined value; and control means for controlling the operation of said second valve in response to operating conditions of said engine such that said at least one second nozzle hole is opened by said second valve when said engine is operating in at least one predetermined operating region; said nozzle body having an axial through hole formed in the tip thereof and having a peripheral wall, said at least one second nozzle hole having an inner end thereof terminating in the peripheral wall of said axial through hole, said second valve comprising a spool valve having a first land axially extending from said first valve toward the tip of said nozzle body and disposed to selectively assume a seated position wherein said first land is fitted in an end of said axial through hole closer to said first valve to close said at least one second nozzle hole, and a lifted position wherein said first land is disengaged from said axial through hole to open said at least one second nozzle hole, an annular groove adjacent said first land and disposed in said axial through hole at a location such that it permanently faces said inner end of said at least one second nozzle hole, and a second land adjacent said annular groove and opposed to said first land with respect to said annular groove, said second land being permanently positioned within said axial through hole.

2. A fuel injection valve as claimed in claim 1, wherein said at least one predetermined operating region of said engine includes a high speed and high load region of said engine.

3. A fuel injection valve as claimed in claim 1, wherein said at least one predetermined operating region of said engine includes a starting region of said engine.

4. A fuel injection valve as claimed in claim 1, wherein said control means comprises sensor means for sensing operating parameters of said engine including at least the rotational speed of said engine and a load on said engine, driving means for driving said second valve, and electronic control means responsive to output from said sensor means for controlling said driving means in a manner such that said driving means drives said second valve to open said at least one second nozzle hole when said engine is operating in said at least one predetermined operating region.

5. A fuel injection valve as claimed in claim 4, wherein said driving means comprises a solenoid valve.

* * * * *